United States Patent [19]

Hofmann

[11] 3,947,342

[45] Mar. 30, 1976

[54] METHOD OF FORMING A COMPOSITE ELECTRODE

[75] Inventor: Gunter A. G. Hofmann, Los Angeles, Calif.

[73] Assignee: Hughes Aircraft Company, Culver City, Calif.

[22] Filed: Jan. 24, 1975

[21] Appl. No.: 543,840

Related U.S. Application Data

[62] Division of Ser. No. 386,115, Aug. 6, 1973, Pat. No. 3,876,905.

[52] U.S. Cl. ..... 204/192; 313/157

[51] Int. Cl.[2] ..... C23C 15/00

[58] Field of Search ..... 204/192, 298

[56] References Cited

UNITED STATES PATENTS 3,374,389 3/1968 Cahour et al. ..... 204/192

3,876,905 4/1975 Lutz et al. ..... 313/157

*Primary Examiner*—Howard S. Williams
*Assistant Examiner*—Aaron Weisstuch
*Attorney, Agent, or Firm*—Allen A. Dicke, Jr.; William H. MacAllister, Jr.

[57] ABSTRACT

Composite electrodes for a crossed-field switch device is formed by positioning a refractory metal structure substantially at the location of its first electrode, sputtering metal from the refractory metal structure onto the second electrode so that the second electrode is coated with refractory material, then removing the refractory metal structure and replacing the first electrode, followed by back sputtering onto the first electrode.

1 Claim, 3 Drawing Figures

METHOD OF FORMING A COMPOSITE ELECTRODE

CROSS REFERENCE

This application is a division of patent application Ser. No. 386,115 filed Aug. 6, 1973, now U.S. Pat. No. 3,876,905 directed to "Composite Electrodes for Cross-Field Switch Device and Method".

BACKGROUND OF THE INVENTION

This invention is directed to a method for making a composite electrode structure for use in crossed-field switch devices.

Crossed-field electrical discharge devices were primarily laboratory curiosities, until recent developments having shown that they are capable of carrying high direct currents and interrupting against high voltages. This capability has resulted in their design into a number of circuit breakers. In such circuit breakers, the crossed-field devices become crossed-field interrupting devices which perform the function of interrupting direct current to result in increasing circuit breaker impedance. Prior patents which can use suitable crossed-field switch devices as their switching elements in circuit breaker environments include K. T. Lian U.S. Pat. No. RE 27,257; K. T. Lian and W. F. Long U.S. Pat. No. 3,641,358; M. A. Lutz and W. F. Long U.S. Pat. No. 3,660,723. These illustrate the manner in which a crossed-field switch device can be used.

Two patents which illustrate particular structure of a crossed-field switch device are G. A. G. Hofmann and R. C. Knechtli U.S. Pat. No. 3,558,960 and M. A. Lutz and R. C. Knechtli U.S. Pat. No. 3,638,061. These patents discuss the maintenance of pressure in the interelectrode gap during conduction. Furthermore, G. A. G. Hofmann U.S. Pat. No. 3,604,977 and M. A. Lutz and G. A. G. Hofmann U.S. Pat. No. 3,678,289 discuss the management and control of the off-switching of crossed-field switch devices by control of the magnetic field. Continuing improvements are being made to enhance the voltage and current capabilities, as well as life and reliability of the crossed-field switch devices.

The electrode surfaces, particularly the cathode surface which is exposed to high intensity discharge in the crossed-field switch device, should be of a material which is resistant to sputtering to maximize tube life, and resistant to the glow-to-arc transition to attain high reliability. These requirements are met by refractory materials. However, the cathode as a whole should have enough mechanical strength to serve as a tube envelope. Furthermore, it should resist eddy currents which are set up by the magnetic field switching, and it should be as economic as possible. These requirements are best met by other than refractory materials.

SUMMARY OF THE INVENTION

In order to aid in the understanding of this invention, it can be stated in essentially summary form that it is directed to the method for making a composite electrode for a crossed-field switch device. The method comprises placing a refractory metal insert in the position of the first electrode and sputtering from the refractory metal insert to form a layer on the surface of the second electrode and subsequently removing the refractory metal insert, installing the first electrode, and back sputtering onto the first electrode so that the device can be operated as a crossed-field switch device with composite electrodes.

It is thus an object of this invention to provide a method by which composite electrodes can be made. It is another object to provide a method for making composite electrodes for crossed-field switch devices which readily and economically produces the composite electrodes. It is a further object to provide a method which, when carried to completion, results in producing composite electrodes of both the first and second electrodes in the crossed-field switch device. It is a further object to provide electrodes for a crossed-field switch device, which electrodes are formed to two different materials, so that each of the materials is positioned to take best advantages of its properties. It is yet another object to provide a crossed-field switch device which has electrodes principally formed of a material suitable for its structural properties and coated with a refractory material especially suited to resist performance degradation of the switch device. It is a further object to provide a method by which composite electrodes are formed.

Other objects and advantages of this invention will become apparent from a study of the following portion of this specification, the claims and the attached drawings.

DESCRIPTION OF THE PREFERRED EMBODIMENT

Figure 1:
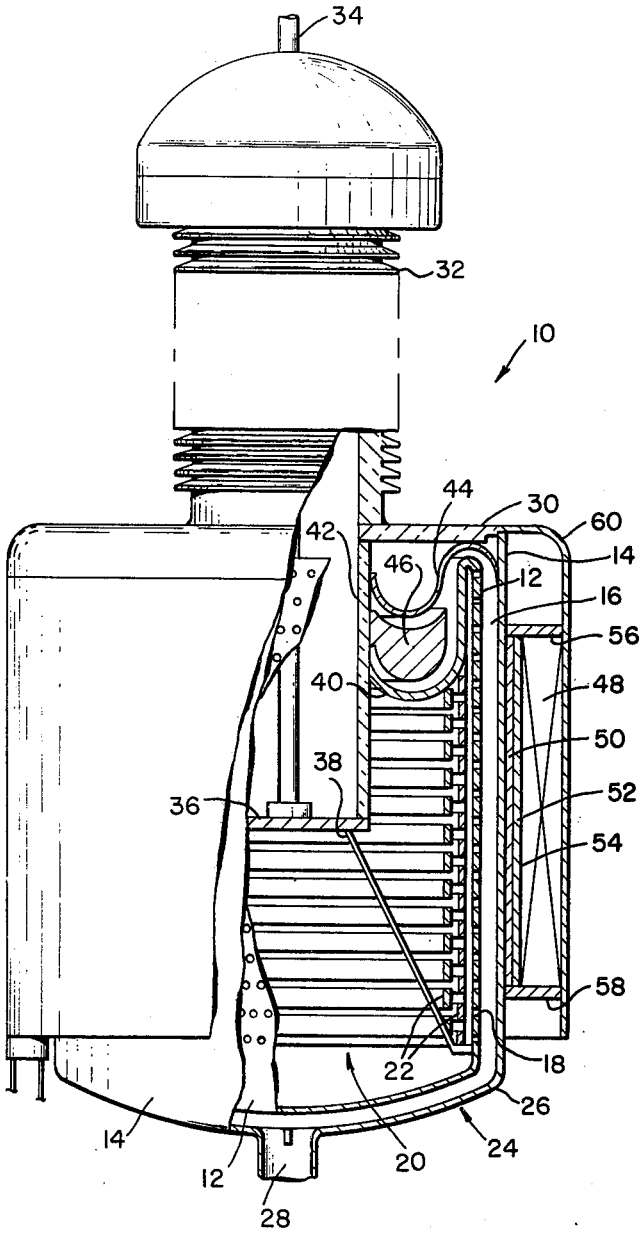
FIG. 1 is a side elevational-view, with parts broken away and parts taken in section, of a crossed-field switch device having composite electrodes, in accordance with this invention.

The crossed-field switch 10 constructed in accordance with this invention is shown in FIG. 1. It comprises an outwardly-facing cylindrical anode 12 around which is positioned an inwardly-facing cathode 14 to define an interelectrode space 16 therebetween. The anode 12 is perforated, as by holes 18 so that the interior space 20 within the anode is permitted to supply gas to the interelectrode space 16 to aid in maintaining conduction, as taught by G. A. G. Hofmann and R. C. Knechtli U.S. Pat. No. 3,558,960. In order to prevent a long, straight line path between the interelectrode space 16 and the anode interior space 20, baffles 22 are provided. These baffles are a first row of axially-spaced cylindrical rings positioned within the interior of the anode and a second set of axially-spaced cylindrical rings spaced interiorly of the first set. These baffle rings are axially offset so that the one set covers the spaces between the rings of the other set. Thus, straight line paths are eliminated. This prevents electrons from directly passing from the interelectrode space 16 into the interior space 20.

Cathode 14 is part of the pressure vessel 24 which provides a structural strength and vacuum integrity to the crossed-field switch 10 and particularly the interelectrode space. Lower shell 26 closes the lower end of the vacuum space and is attached to the cylindrical wall which forms cathode 14. Any convenient supporting means, such as leg 28 can be used to support the entire structure.

Support plate 30 is in the form of a disc which closes the upper end of the cylinder formed by cathode 14 and seals against it. It is raiseable for disassembly of the device. When raised, the insulator 42 and anode structure come up out of the cathode tank. Stand-off bushing 32 is of insulator material. Anode connection 34 is vacuum-sealed with respect to the bushing and extends out of the end thereof for connection into a circuit. The anode connection 34 is in the form of a rod which extends down the interior of standoff bushing 32 into the interior of the anode. Anode connection 34 terminates in support plate 36. A plurality of legs 38 extend from support plate 36 and are attached to anode 12 to support the anode. The anode baffles are supported by rods which are positioned axially between the sets of anode baffles and are secured at their lower ends to legs 38. The upper end of anode 12 is provided with a re-entrant curved section 40 which engages against the outer surface of insulator tube 42 which descends from support plate 30 and which carries support plate 36. Spacer 44 is at cathode potential and electrically floating electrode 46 fills the gap to prevent Paschen breakdown.

A magnetic field is necessary to interengage with the electrical field in the interelectrode space to provide the crossed-field low pressure plasma discharge in the interelectrode space. The main magnetic field is provided by field coil 48 which extends circumferentially around the interelectrode space 16. In the particular example, a 100-turn field coil is provided. By passing 20 amperes through the main field coil 48, an interelectrode space magnetic field of 80 GAUSS is provided so that conduction condtions exist when the helium gas pressure in the interelectrode space is about 0.05 TORR and an electric field of about 250 volts per centimeter is present. In this situation, the magnetic field is said to be above the critical value so that conduction can take place.

In order to quickly turn off the magnetic field to stop conduction of the crossed-field switch, a switch coil is necessary. Switch coil 50 is a one-turn coil. When it is energized to buck the field coil 48, it drives the net magnetic field below the critical value so that the device becomes nonconducting. See M. A. Lutz and G. A. G. Hofmann, U.S. Pat. No. 3,678,289. Thus, the crossed-field switch device 10 is an off-switch. Problems arise, if the switch tube dimensions are large and the vacuum envelope is a metallic tank, as in the present case. The attenuation of the magnetic field diffusing through the tank wall is considerable and requires a relatively high outside field to achieve the necessary field strength in the interelectrode space.

As is seen in the drawing, the primary or main field coil 48 is separated from off-switching coil 50 to reduce capacitive coupling. Short circuit winding 52 between the coils reduces inductive coupling. The injection of transients into the power supply for field coil 48 is therefore reduced, eliminating the need for a blocking choke in the circuit of coil 48. As stated, switch coil 50 consists of only one or a few turns. With such few turns, only low driving voltages are necessary with the result that only moderate insulation requirements are present. In the preferred embodiment, the off-switching field coil 50 is a single turn of aluminum with an anodized surface for insulation. A driving voltage of 4,000 volts and a pulse current of 20,000 amps is sufficient to drive the net magnetic field below the critical value. A fast rise time of the switching pulse can be achieved with relatively low driving voltages.

Insulating end rings 56 and 58 support the cylindrical parts of the coil structures. Off-switching coil 50 is supported closely adjacent the outer surface of the cylindrical tank wall which forms cathode 14. Next, the short circuit winding 52 is positioned around the switch coil 50. Next, insulating mandrel 54 is positioned around the short circuit winding. Finally, the primary field winding 48 is wound around the mandrel 54. An electrostatic shield 60 surrounds the field coils to minimize electromagnetic interference from the coils onto the adjacent exterior spaces.

Figure 2:
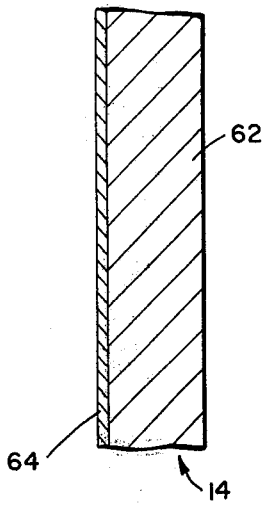
FIG. 2 is an enlarged sectional view, with parts broken away, of one of the composite electrodes.
Figure 3:
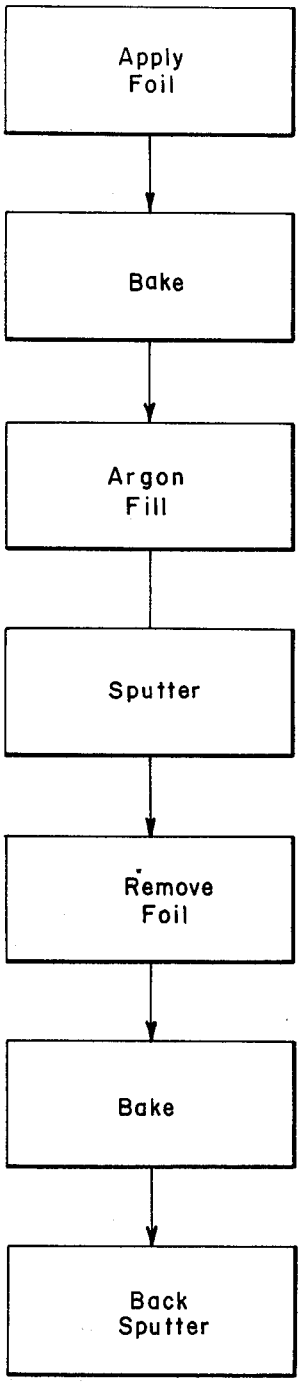
FIG. 3 is a sequence diagram of the preferred practice of the method of this invention.

FIG. 2 shows one of the electrodes of the crossed-field switch device 10. While the electrode illustrated in FIG. 2 could be either of the anode or cathode electrodes cathode 14 is illustrated. The electrode comprises a body material 62 and a coating material 64. The electrode as a whole must meet particular requirements. For example, the cathode 14 should have enough mechanical strength to serve as the tube envelope. Furthermore, it should resist the eddy currents which are set up by the magnetic field switching. Also, the body material should be as economical as possible. These three requirements are best met by non-refractory materials. The body material thus can be broadly defined as a non-refractory solid electrical conductor. In order to be further definitive and not limitative, the following body materials form a preferred group: graphite, stainless steel, or aluminum.

It should be emphasized that the body material 62 is desirably of higher electrical resistivity than the deposited material, because eddy currents set up in the relatively thick body material severely impede the diffusion of the magnetic field into the tube, field inhomogenieties can cause the plasma to concentrate in localized areas and lead to a glow-to-arc transition. Arc discharge is undesirable, because it cannot be off-switched by decreased magnetic field. A reasonable magnetic diffusion time is less than 20 microseconds. Thus, in a substrate which has a thinkness sufficient to serve as a vacuum envelope, for example a 3 millimeter thickness, a moderately high electrical resistivity is desired. The resistivity found in type 303 stainless steel, about 72 micro-ohm-centimeter is suitable.

The coating material 64 is exposed to the high intensity discharge in the crossed-field switch device. It should be of a material which is resistant to sputtering, in order to obtain maximum tube life. Furthermore, it should be resistant to glow-to-arc discharge transistions, in order to have high off-switching reliability. These requirements are best met by refractory materials, such as hafnium, tantalum, tungsten, zirconium and rhenium. Several methods are available to deposit the coating material 64 onto the substrate 62. A few only should be cited: plasma spraying, chemical or normal vapor deposition, and explosively bonding.

One preferable process by which the deposition is accomplished is sputter deposition. The first step of this process is to place a layer of refractory metal in the position of one of the electrodes and sputter it onto the other electrode. Thus, the above-described anode structure could be removed by lifting it out of the top of the device 10, and a temporary anode of refractory material could be placed therein as a source for material to be sputtered onto the cathode. It is much preferred, however, to simply apply a refractory metal foil around the exterior of anode 12 so that the refractory metal foil acts as an anode surface facing the interelectrode space. Thus, the first step of the preferred embodiment of the process is to apply foil around the exterior cylindrical surface of anode 12 and to reinstall the anode structure within the cathode. The next step is to bake and evacuate. Baking at 200° C. for 8 hours followed by evacuation to $10^{-6}$ Torr is satisfactory. After the evacuation, the device is filed with argon to a pressure of 0.1 Torr.

Sputtering of the refractory metal from the foil onto the interior of the cathode surface is now accomplished by applying a voltage of 500 V, with the refractory foil negative and the axial magnetic field applied. Under these conditions, there is a glow discharge in the interelectrode space. The ions attracted toward the refractory foil cause dislodgement of refractory metal molecules (sputtering). These diffuse to the cathode and are deposited thereon. Sputtering is carried on until a layer of about 40 microns of sputtered refractory material is deposited onto the interior cathode surface. When the magnetic field is applied, the plasma and resultant sputtering and sputter deposition area are limited to the direct interelectrode space. No appreciable sputtered refractory metal ions are deposited on the interior insulator surfaces or other areas away from the interelectrode plasma discharge.

Next, the device is dissembled and the foil is removed. Then, it is again baked and evacuated, followed by an argon fill. The baking, evacuation and fill are under the same conditions as the steps described above. Now, back-sputtering is accomplished by applying an interelectrode voltage at about the same value as before, but with the cathode negative and with the axial magnetic field. Sputtering of the refractory material from the coating on the cathode to the anode is accomplished. Back-sputtering is carried on until about half the material is sputtered onto the anode. Now, the refractory layer is about 20 microns on the cathode interior surface and the anode exterior surface. A charge of about 10 coulombs per square cm is necessary to sputter each 20 microns of thickness of refractory material.

In view of the fact that the refractory material is transferred by sputtering in glow discharge it is clear that all of the surfaces which are subject to the plasma in ordinary conduction are sputter-coated with the refractory material. Thus, all surfaces which are adjacent the plasma during normal operation of the device 10 are coated with refractory metal.

Each of the patents and other sources of information referred to above are incorporated herein in their entirety by this reference. This invention having been described in its preferred embodiment, it is clear that it is susceptible to numerous modifications and embodiments within the ability of those skilled in the art and without the exercise of the inventive faculty. Accordingly the scope of this invention is defined by the scope of the following claims.

What is claimed is:

1. The method of forming a refractory coated electrode for a crossed-field switch device having a first and a second electrode spaced from each other, comprising the steps of:

positioning a refractory metal structure substantially at the location of the surface of the first electrode;

applying an interelectrode field and a crossed magnetic field to sputter material from said refractory metal structure across the interelectrode space onto the second electrode facing the refractory metal structure;

removing the refractory metal structure and replacing the first electrode; and back-sputtering refractory metal coating material from the second electrode to the first electrode by application of crossed electric and magnetic fields so that both of the electrodes carry refractory metal coating thereon facing the interelectrode space so that the crossed-field switch device can be operated with refractory metal-coated surfaces facing the plasma in the interelectrode space.

* * * * *

UNITED STATES PATENT OFFICE

CERTIFICATE OF CORRECTION

PATENT NO. : 3,947,342

DATED March 30, 1976

INVENTOR(S) : Gunter A. G. Hofmann

It is certified that error appears in the above-identified patent and that said Letters Patent are hereby corrected as shown below:

Column 1, Line 27, "RE 27,257" should be --RE 27,557--.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*